United States Patent [19]

Kubota

[11] 4,293,853

[45] Oct. 6, 1981

[54] METHOD AND APPARATUS FOR DETECTING FLOW INSTABILITY IN STEAM GENERATOR

[75] Inventor: Jun Kubota, Tokyo, Japan

[73] Assignee: Doryokuro Kakunenryo Kaihatsu Jigyodan, Tokyo, Japan

[21] Appl. No.: 125,176

[22] Filed: Feb. 27, 1980

[30] Foreign Application Priority Data

Mar. 8, 1979 [JP] Japan ..... 54/26983

[51] Int. Cl.[3] ..... G08B 21/00

[52] U.S. Cl. ..... 340/611; 122/452; 165/11 R; 376/246

[58] Field of Search ..... 340/611, 614, 626; 73/861.44, 861.47, 198; 122/452, 451.2; 165/11 R; 176/20 R

[56] References Cited

U.S. PATENT DOCUMENTS

| | | | |
|---|---|---|---|
| 2,322,975 | 6/1943 | Schroeder | 122/451.2 |
| 2,323,013 | 6/1943 | Decker | 122/451.2 |
| 2,375,431 | 5/1945 | Mastenbrook et al. | 122/451.2 |
| 3,061,533 | 10/1962 | Shannon et al. | 176/20 R |
| 3,247,069 | 4/1966 | Powell et al. | 176/20 R |
| 3,275,524 | 9/1966 | Williams | 176/20 R |
| 3,332,849 | 7/1967 | Kägi | 176/20 R |
| 3,791,922 | 2/1974 | Musick | 176/20 R |
| 3,930,937 | 1/1976 | Torres | 176/20 R |

OTHER PUBLICATIONS

"Flow Instability Detection in a Sodium-Heated Steam Generator by Noise Analysis" by Tamaski et al., *Nuclear Power Plant Control and Instrumentation*, vol. 1, pp. 317-329 (Apr. 1978).

*Primary Examiner*—John W. Caldwell, Sr.
*Assistant Examiner*—Daniel Myer
*Attorney, Agent, or Firm*—Fleit & Jacobson

[57] ABSTRACT

A method for detecting the flow instability in steam generators is provided. First, a number of limit values on the differential pressure between the water-side inlet and outlet of the steam generator are determined at different feedwater flow rates. The limit values define the onset of the flow instability. By connecting the thus determined limit values, a boundary line defining the occurrence of the flow instability is obtained. Second, it is checked whether the measured differential pressure between the inlet and outlet at an actual feedwater flow rate is above or below the boundary line so as to determine if the flow instability has occurred or not in the steam generator. An apparatus for accomplishing the method is also provided.

5 Claims, 3 Drawing Figures

METHOD AND APPARATUS FOR DETECTING FLOW INSTABILITY IN STEAM GENERATOR

BACKGROUND OF THE INVENTION

This invention relates to a method and apparatus for easily detecting the water-side flow instability in steam generators.

In steam generators for fast breeder reactors, gas furnaces and fossil fuel furnaces in general thermal power plants, there is a possibility that the flow instability will occur on the water side. The flow instability described above means the phenomenon in which fluid, i.e. water and vapor, pulsates or vibrates self-excitedly in heat tubes. Continued operation of the steam generator, overlooking the existance of such flow instability, may incur damages to the heat tube due to thermal fatigue, which in turn injures safety of the steam generator. Especially in the sodium-heated steam generator, the damage of the heat tube will cause sodium-water reaction which may lead to a serious disaster. For this reason, the development of the method and apparatus for easily and reliably detecting the occurrence of the flow instability has been strongly desired.

One of the conventional methods for detecting the flow instability is the one employing noise analysis. (T. Tamaori, J. Kubota et al. "Flow Instability Detection in Sodium-Heated Steam Generator by Noise Analysis", International Symposium on Nuclear Power Plant Control and Instrumentation, Cannes, France 24–28 April, 1978). This method is based on the noise analysis of process signals measured at the inlet and outlet of a steam generator, and is required to check the correlation between the process signals measured at the inlet and outlet to detect the flow instability. However, this method has the following disadvantages: the processing of signals is complicated owing to the computation of correlation; the equipment according to this method is expensive because it requires minicomputers or microcomputers; and there is a large time lag when the flow is unsteady. For the above reasons, this method cannot satisfactorily be applied to actual steam generators in operation. Other methods now being considered for detecting the flow instability are to insert a thermocouple into the heat tube to detect the fluctuation of the temperature or to directly install a feedwater flow meter to the heat tube. These methods may be effective for research or experimental equipments but almost inapplicable to actual steam generators in operation in the light of safety and reliability.

SUMMARY OF THE INVENTION

An object of this invention is to provide a novel and improved method and apparatus for detecting the flow instability in steam generators.

Another object of this invention is to provide a reliable inexpensive method of detecting the flow instability in steam generator, wherein the processing of signals is simple without impairing the safety of the steam generator.

Still another object of this invention is to provide a method of detecting the flow instability in the steam generator, which is effective whether the flow is steady or unsteady.

A further object of this invention is to provide an apparatus which effectively embodies the above-mentioned method of detecting the flow instability in steam generator.

In general, the differential pressure $\Delta P$ between the water-side inlet and outlet of the steam generator, i.e., a difference between the pressure of water coming into the steam generator and the pressure of vapor going out from the steam generator, increases according as the feedwater flow rate F increases. When the feedwater flow rate is constant, the differential pressure has a characteristic that it increases in proportion to the amount of heat applied. As for the flow instability, when the feedwater flow rate is constant, the flow instability is more likely to occur as the amount of heat applied increases. The instability results when the amount of heat exceeds a certain value. As a result of the experimental and theoretical research among these relationships, it has been found that a limit on the differential pressure $\Delta P$ defining the occurrence of the flow instability can be determined at each feedwater flow rate. This invention has been performed on the basis of the aforementioned fact. In FIG. 1, a boundary line A is the line connecting the limit differential pressure $\Delta P$ between the water-side inlet and outlet which define the occurrence of the flow instability at the feedwater flow rate F. Differential pressures below this boundary line A fall into a stable operation region and those higher than the boundary line A fall into an unstable region.

In detecting the flow instability in the steam generator according to the method of this invention, the first step is to determine a number of limit values on the differential pressure—at which the flow instability is initiated—between the water-side inlet and outlet of the steam generator at different feedwater flow rates and obtain a boundary line that defines the occurrence of the flow instability by connecting the limit values. The next step is to check whether the measured differential pressure between the inlet and outlet at an actual feedwater flow rate is above or below the boundary line so as to determine if the flow instability has occurred or not in the steam generator.

The differential pressure between the water-side inlet and outlet of the steam generator, i.e., a difference between the water pressure in the feedwater pipe and the steam pressure in the steam pipe, can be detected by a differential pressure detector. The apparatus of this invention for detecting the flow instability in the steam generator comprises a differential pressure detector; a bias signal generator which responds to a flow rate signal transmitted from a flow meter installed in a feedwater pipe and generates a signal corresponding to a limit value on the differential pressure between the waterside inlet and outlet, said limit value defining the onset of the flow instability at a measured feedwater flow rate; a comparator for comparing the output from the differential pressure detector with that from the bias signal generator and outputting the comparison result; and an alarm which responds to the signal outputted from the comparator.

DETAILED DESCRIPTION OF THE INVENTION

Figure 1:
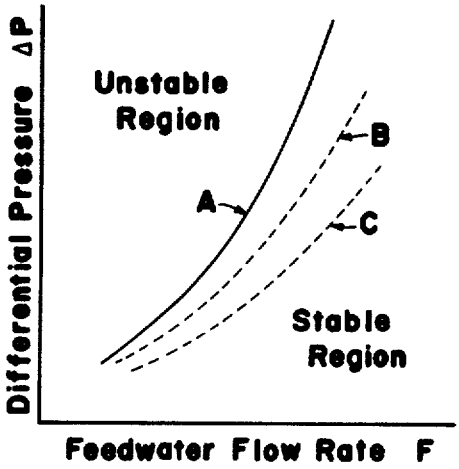
FIG. 1 is a graph showing the principle of this invention for detecting the occurrence of the flow instability, in which the limit values on the differential pressure $\Delta P$ between the water-side inlet and outlet of the steam generator for the flow instability are plotted against different feedwater flow rates F to obtain the boundary line A defining the occurrence of the flow instability.

The boundary line A, shown in FIG. 1, defining the occurrence of the flow instability can be determined experimentally and analytically for any steam generator. To determine the boundary line experimentally, an actual steam generator is used to cause the flow instability over the wide range of operation parameters so as to obtain the relation between the water-side inlet/outlet differential pressure and the feedwater flow rate under the conditions in which the flow instability develops. Then, the boundary line can be obtained on the basis of this relation. In many cases, however, it is desirable to avoid causing the flow instability in the actual generator even in experiments. The boundary line can be determined analytically, in such cases, by using computation codes for predicting the occurrence of the flow instability. The method employing the analytical computation code may be the one generally used for simulating the dynamic natural phenomena. Since these analytical methods are well known to those skilled in this technical field, the detailed description is omitted. (For example, a treatise by L. E. Efferding published in 1968: DYNAM a digital computer program for study of the dynamic stability of once-through boiling flow with steam super-heat, GAMD—1968). Roughly speaking, the flow instability is predicted, for example, in the following way: Under proper assumptions, an analytical model is built up and various equations involving mass, momentum and energy derived from the law of conservation of energy are solved using various mathematical methods to predict the flow instability under a certain operating condition of the steam generator. Other computation models and methods may be used as long as they can predict the flow instability accurately under a given operating condition. Thus, it is possible to detect the occurrence of the flow instability in the steam generator by continuously monitoring the differential pressure between the water-side inlet and outlet and check whether the differential pressure exceeds the boundary line A in FIG. 1.

Figure 2:
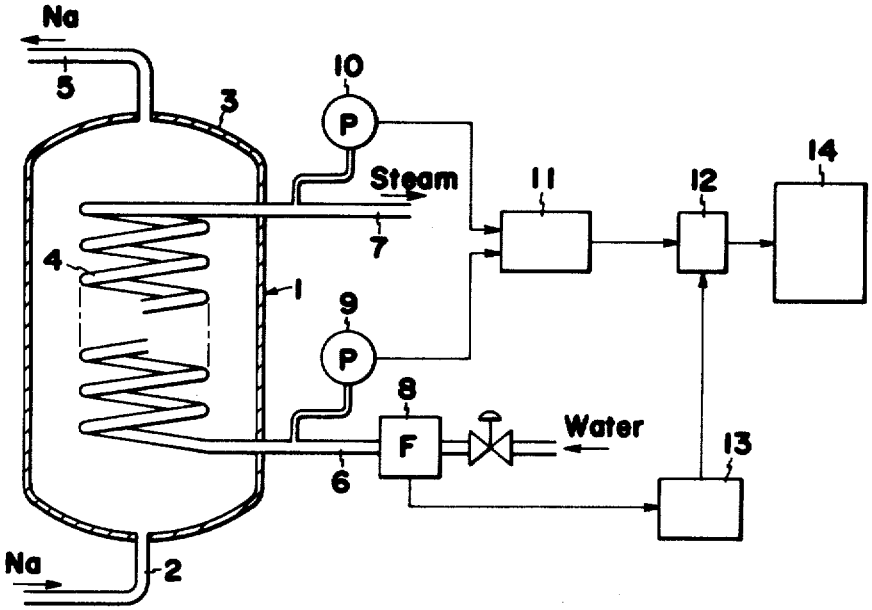
FIG. 2 is a schematic diagram showing an embodiment of the apparatus according to this invention.

Now, we will describe hereinbelow the detecting apparatus of this invention. FIG. 2 is a schematic diagram showing one embodiment of the apparatus. A steam generator 1 may be of any construction. Here, a shell-and-tube type is shown as an example. Heating fluid such as liquid sodium flows through the shell and water flows through the tube. The heating fluid is introduced through a heating fluid supply pipe 2 into the shell 3 where it contacts the outer wall of the heat tube 4, and then it is discharged through a heating fluid discharge pipe 5. On the other hand, the water is supplied through a feedwater pipe 6 to the heat tube 4 contained in the steam generator, where it is heated by the heating fluid surrounding the heat tube 4 until it becomes vaporized. The resulting steam is then discharged through a steam pipe 7. A feedwater flow meter 8 and a water pressure detector 9 are installed to the feedwater pipe 6, and a steam pressure detector 10 to the steam pipe 7. These instruments are similar to those installed in the conventional steam generator.

A signal of the water pressure detected by the water pressure detector 9 and a signal of the steam pressure detected by the steam pressure detector 10 are both sent to a differential pressure signal generator 11 which generates a differential pressure signal to be transmitted to one of two input terminals of a comparator 12. A signal of the feedwater flow rate is sent from the feedwater flow meter 8 to a bias signal generator 13. The bias signal generator 13 receives the feedwater flow rate signal and outputs a signal of the limit value on the differential pressure (the boundary line A of FIG. 1) which defines the onset of the flow instability at the measured feedwater flow rate. A function generator, for example, may be used as the bias signal generator 13. When the boundary line A in FIG. 1 is approximated by a quadratic equation, an amplifier with a square-law characteristic may be employed as the bias signal generator 13. The bias signal thus obtained is sent to another input terminal of the comparator 12 where it is compared with the water-side input/output differential pressure signal. If the water-side input/output differential pressure signal is greater than the bias signal, a signal is sent to the alarm 14 to flicker the lamp and sound the buzzer to alarm an operator to the occurrence of the flow instability.

To use the apparatus effectively, two or three auxiliary boundary lines B, C in addition to the boundary line A are established such that they lie slightly away from the boundary line A toward the stable region. Further, the bias signal generator 13 is made to output auxiliary limit values corresponding to these auxiliary boundary lines B, C, and the comparator 12 is provided with logic circuits necessary to issue two or three warnings. Thus, these warnings inform the operator of the approaching critical condition before the flow instability occurs, so that the steam generator can always be operated within the stable region.

Figure 3:
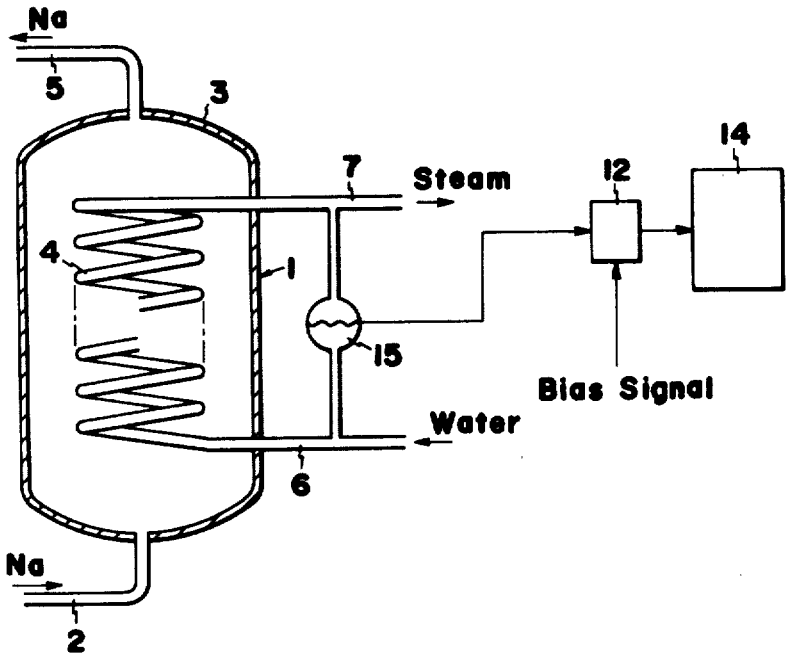
FIG. 3 is a schematic diagram showing another embodiment of the apparatus according to this invention.

There is described hereinabove how the apparatus of this invention detects the onset of the flow instability in the steam generator. However, since in the above-described embodiment the difference between the water pressure in the feedwater pipe and the steam pressure in the steam pipe is measured in absolute pressure, errors are likely to enter the measured differential pressure. Therefore, another embodiment of this invention employs the conventional differential pressure detector of known construction which generates voltage or current signals proportional to the differential pressure. As shown in FIG. 3, the differential pressure detector 15 of a diaphragm type is arranged between the feedwater pipe 6 and the steam pipe 7, so as to apply the water pressure to one of its chamber on one side of the diaphram and apply the steam pressure to the other chamber. The differential pressure detector 15 outputs a signal proportional to the differential pressure between the water and the steam. The construction of other components may be similar to that shown in FIG. 2. A signal of the differential pressure detected by the detector 15 is inputted into the comparator 12, which acts in a manner similar to that described in FIG. 2.

Since the difference between the water pressure in the feedwater pipe 6 and the steam pressure in the steam pipe 7 is detected by the differential pressure detector 15, as described above, the flow instability can be detected accurately.

The method and apparatus of this invention with the aforementioned construction offer the following features and advantages in detecting the flow instability in steam generators: the signal processing is simple and the computer is not required, resulting in reduction in cost;

since the differential pressure signal is directly used, there is no time lag and this signal is valid regardless of whether the flow is in steady state or in unsteady state; and signals required for flow instability detection are only the feedwater flow rate and the differential pressure between the water and steam, and these signals can be obtained from the instruments already installed in the steam generator, so that the flow instability can be detected highly reliably without impairing the safety of the apparatus and without requiring additional instruments.

I claim:

1. A method for detecting the flow instability in steam generators, comprising the steps of: determining a number of limit values on the differential pressure between the water-side inlet and outlet of the steam generator, said limit values defining the onset of the flow instability at various feedwater flow rates; obtaining a boundary line defining the occurrence of the flow instability by connecting the limit values; and checking whether the differential pressure exceeds the boundary line at the current feedwater flow rate to detect the flow instability in the steam generator.

2. An apparatus for detecting the flow instability in steam generators comprising: a differential pressure detector for detecting the difference between the water pressure in a feedwater pipe and the steam pressure in a steam pipe of the steam generator; a bias signal generator which responds to a flow rate signal transmitted from a flow meter installed in the feedwater pipe and generates a signal corresponding to a limit value on the differential pressure between the waterside inlet and outlet, said limit value defining the onset of the flow instability at a measured feedwater flow rate; a comparator for comparing the output from the differential pressure detector with that from the bias signal generator and outputting a comparison result; and an alarm means which responds to the comparison result obtained by the comparator.

3. The apparatus according to claim 2, wherein said differential pressure detector is a differential pressure signal generator which generates a signal corresponding to the difference between the water pressure and the steam pressure, the water pressure being detected by a water pressure detector installed in the feedwater pipe and the steam pressure being detected by a steam pressure detector installed in the steam pipe.

4. The apparatus according to claim 2, wherein said differential pressure detector is a differential pressure detector of a diaphragm type arranged between the feedwater pipe and the steam pipe, the water pressure being applied to one side of the diaphragm and the steam pressure being applied to the other side of the diaphragm, said detector generating a signal proportional to the difference between the water pressure and the steam pressure.

5. The apparatus according to claim 2, wherein said bias signal generator generates signals corresponding to several auxiliary limit values below the limit value defining the onset of the flow instability, as well as the signal corresponding to the limit value defining the onset of the flow instability, whereby these signals from the bias signal generator are compared with the output from the differential pressure detector so as to cause the alarm means to inform in several steps human operators that the occurrence of the flow instability is approaching.

* * * * *